US005131634A

United States Patent [19]

Abodishish et al.

[11] Patent Number: 5,131,634

[45] Date of Patent: Jul. 21, 1992

[54] SUBLIMER-REACTOR SYSTEM WITH WEIGHING MEANS

[75] Inventors: Hani A. Abodishish, Aiken, S.C.; R. James Adams, West Point, Utah

[73] Assignee: Westinghouse Electric Corp., Pittsburgh, Pa.

[21] Appl. No.: 772,506

[22] Filed: Oct. 7, 1991

[51] Int. Cl.[5] ..... C22B 9/02

[52] U.S. Cl. ..... 266/91; 266/148; 266/149; 266/905; 75/386

[58] Field of Search ..... 266/91, 148, 146, 905; 75/386

[56] References Cited

U.S. PATENT DOCUMENTS

| | | | |
|---|---|---|---|
| 4,511,399 | 4/1985 | Kwon et al. | 266/905 |
| 4,556,535 | 12/1985 | Bowman et al. | 266/91 |
| 4,613,366 | 9/1986 | Kwon et al. | 266/905 |
| 4,749,409 | 6/1988 | Ishizuka | 75/612 |
| 4,897,116 | 1/1990 | Scheel | 75/10.28 |

*Primary Examiner*—Melvyn J. Andrews
*Attorney, Agent, or Firm*—J. C. Valentine

[57] ABSTRACT

A sublimer-reactor system for reducing Group IVB metals with magnesium has a sublimer spaced from a reactor with a gas flow control valve in piping interconnecting them. A load cell weighs the feed in the sublimer and outputs a signal to the control valve to control the vapor flow of feed vapors to the reactor.

4 Claims, 1 Drawing Sheet

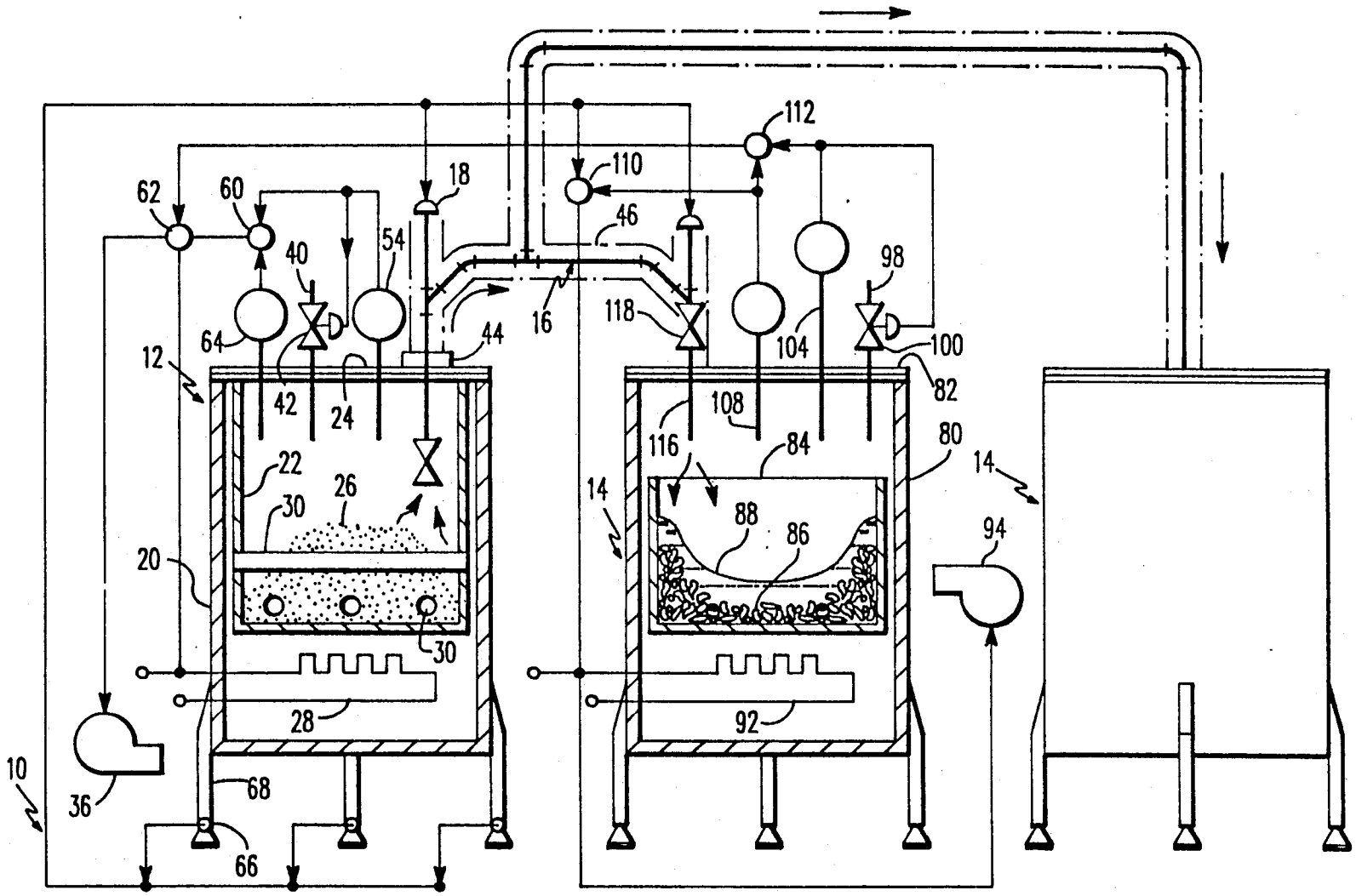
10
12
14
14
16
18
20
22
24
26
28
30
30
36
40
42
44
46
54
60
62
64
66
68
80
82
84
86
88
92
94
98
100
104
108
110
112
116
118

SUBLIMER-REACTOR SYSTEM WITH WEIGHING MEANS

BACKGROUND

The present invention relates to a sublimer-reactor system for reducing a Group IVB metal chloride with magnesium.

Group IVB metals, including zirconium and hafnium, commercially are produced from sands by Kroll reduction processes where the sands are carbochlorinated to produce the metals in the form of chlorides and primarily tetrachlorides. The chlorides are batch fed to sublimers which vaporize the chlorides. The vapors then flow into reactors where they are reduced with magnesium to form a metal sponge in magnesium chloride. U.S. Pat. Nos. 4,511,399; 4,613,366 and 4,897,116 disclose the structure and operation of known sublimer-reactor systems, which are incorporated by reference. These systems may be employed to produce any Group IVB metal.

The prior art Kroll processes normally employ substantial amounts of excess magnesium to assure the complete reduction of the feed. This practice undesirably extends the cycle time of the Kroll processes because the excess magnesium requires additional melting time. In addition the use of excess magnesium commercially requires that the unreacted magnesium be recovered and recycled in order to reduce raw material costs. Recycled magnesium introduces water vapor and adsorbed contaminating gases into the feed, which must be desorbed in a degassing step before the reaction proceeds. U.S. Pat. No. 4,511,399 discloses the use of a level sensing system in a continuously fed sublimer to measure the chlorides, but even this system employs substantial amounts of excess magnesium which flow from a reactor through a magnesium tap valve to a recovery vessel.

Level sensors cannot be employed in sublimers used in case of zirconium or hafnium production with sufficient precision to measure the chlorides because the surface of the powder may not be level. This is caused by the tendency of the powders adjacent the heating surfaces of the sublimers to vaporize before the bulk of the powder, which may develop a cone shape. Thus the measured level is merely an approximation.

The prior art Kroll processes also employ extended and uncontrolled reduction steps where the exthermic reaction causes the temperature to reach >950° C. This step is taken to assure the complete reduction of the chlorides. It is believed that this practice permits substantial amounts of iron due to higher solubility of iron in magnesium at >900° C. Iron will diffuse from the reactor crucible containing the sponge into the sponge. It is believed that the best reaction temperature should be controlled between 800°-900° C. to produce higher quality zirconium, hafnium and the like (metal sponge).

SUMMARY OF THE INVENTION

It is an object of the present invention to shorten the normal cycle time required to react the chlorides in a sublimer-reactor system. It is a further object to reduce the amount of excess magnesium which is employed and achieve better control on reaction temperature.

With these objects in view, the present invention relates to a sublimer-reactor system for reducing Group IVB chlorides with magnesium which generally has a sublimer for vaporizing Group IVB metal chloride powder and one or more parallel reactors for reacting the vaporized chlorides with molten magnesium to produce the metal and byproduct magnesium chloride. A piping system interconnects the sublimer and the reactors in gas flow communication and flow control means in the piping selectively interconnects the sublimer with the one or more reactors.

A weighing means, which is preferably a load cell, is operatively connected to the sublimer and controls the flow of vaporized chlorides to the selected reactor in response to the weight of the sublimer and its contents. Such a system may be advantageously employed to introduce an amount of chlorides into a reactor to substantially react the chlorides and the magnesium so that there need be little, if any, magnesium recycled or reactants lost. In addition a charge of the chlorides may be fed to an off-line sublimer where they may be pre-evacuated and stored at high temperatures of up to about 275° C. without rehandling so that there is less moisture absorption and less lost time needed to degas a charge. Alternatively the chlorides may be continuously fed to an on-line sublimer having a large residence time.

In a preferred embodiment of the present invention, there is a cooling means for cooling the reactor which is responsive to the weighing means. This arrangement permits the reacted products in the reactor to be cooled as soon as practicable after the proper amount of chlorides has been fed to the reactor. Thus there is less time at high temperature when iron and other contaminants may diffuse from the reactor crucible into the sponge metal.

DESCRIPTION OF THE DRAWING

The invention will become more readily apparent from the following description of a preferred embodiment thereof shown, by way of example only, in the accompanying drawing, which schematically shows a sublimer-reactor system embodying the present invention.

DESCRIPTION OF A PREFERRED EMBODIMENT

The accompanying figure generally shows a sublimer-reactor system 10 having a sublimer 12 spaced apart from a reactor 14. The sublimer 12 and reactor 14 are interconnected by a piping system 16 which also interconnects one or more other reactors 14 disposed in parallel with the shown reactor 14. Flow control means such as a flow control valve 18 in the piping system permit operative interconnection of one or more reactors 14 with the sublimer 12. The system 10 may comprise up to four reactors 14 or more depending upon equipment sizes and production scheduling. In addition there may be more than one sublimer 12 connected in the system so that, e.g., one sublimer may be on-line vaporizing a batch of chlorides while a second sublimer (not shown) is off-line being charged with a fresh batch or otherwise, being prepared to go on-line. The sublimer-reactor system 10 may be employed to produce any Group IVB metal, although it will be described below in connection with the production of zirconium.

The sublimer 12 generally comprises a shell 20 supporting a flanged retort 22 having a removable lid 24. The lid 24 may be removed to charge the retort 22 with zirconium tetrachloride powder 26. In another embodiment, the lid 24 may have a charging connection (not shown) through which the powder may be introduced without removing the lid 24. A heater 28, which may be an induction heater, is disposed in the shell 20 for heating the retort 22 and its charge 26 up to about 275° C. The retort 22 may have hollow tubular members 30 extending through the charge 26 for circulating heated gases through the interior portion of the retort 22 to more quickly heat up the charge 26.

A cooling means such as a blower 36 may be employed to blow cooling air onto the shell 20 of the sublimer 12 to cool the retort 22 to a lower temperature. In another embodiment of the present invention, a blower may be employed to blow air or another gas into the shell 20 through short ducts. The air would then be vented independently of the gas in the retort 22. The retort 22 has a vent line 40 with an operated valve 42 for venting water vapor and other gases to a condenser and evacuation system (not shown). A process outlet 44 permits the chlorides to flow from the retort 22 through interconnecting piping 16 to the reactor 14. The piping 16 and flow control valve 18 are electrically heat traced with lines 46 to prevent the flowing chlorides from condensing.

An argon purged pressure transmitter 54 senses the pressure (vacuum) in the retort 22 for outputting control signals to the heater 28, blower 36 and the vent valve 42 via a select switch 60, an interlock 62 and other conventional devices which need not be specifically described. A thermal element 64 in the lid 24 (as shown) or in the shell 20 (not shown), such as a thermocouple, senses the temperature in the retort 22 for outputting control signals to the heater 28 and to the blower 36. In the accompanying drawing, all of the instrumentation control lines are shown as dashed to distinguish the process lines.

The sublimer 12 has weighing means 66 operatively connected with the shell 20 for weighing the powder 26 in the retort 22. Advantageously the amount of powder in the retort can be accurately determined without a level sensing device. The weighing means 66 is preferably a heavy duty load cell which measures strain or magnetic changes for loads of up to about 20 tons. Most preferably the sublimer 12 is supported by three legs 68 suspended three load cells 66, which in turn are mounted on structural supports (not shown). The weighing means 66 outputs a signal by conventional instrumentation (not shown) to the flow control valve 18 in line 16. In another embodiment, the weighing means 66 outputs a signal via an information processor to a flow control valve in a branch pipe connected with a selected reactor 14 (not shown).

The reactor 14 generally has a flanged shell 80 with a lid 82 for containing a crucible 84 originally charged with magnesium bars and perhaps recycle magnesium. The crucible 84 may, but need not, contain excessive amounts of magnesium. The crucible 84 is open to the general atmosphere in the shell 80. As shown, the crucible 84 contains a metal sponge 86 submerged in a molten magnesium chloride pool 88 which may also contain molten magnesium. A heating means 92, such as an induction heater, is provided in the shell 80 to heat the reactants up to about 850° C. or more. A cooling means such as a blower 94 is provided- to blow air on the shell 80 to cool the crucible 84 and its contents. Argon or other gas may be introduced to backfill the reactor 14 through a connection (not shown).

In another embodiment, a blower may circulate argon or other gas between the reactor 14 and a heat exchanger to more rapidly cool the crucible 84 (not shown). In addition an air blower may in another embodiment be piped into the shell 80 so that air may be blown through the shell 80 when the temperature of the crucible has fallen to about 500° C. or less (not shown).

The gases in the reactor 14 are vented through a vent line 98 by an operated valve 100 which is responsive to an argon purged pressure transmitter 104. The gases flow through a condenser to an evacuation system (not shown). A thermal element 108 such as a thermocouple senses the temperature in the reactor 14 and outputs a control signal via an interlock 110 to the heater 92 and the blower 94. The heater 92 and blower 94 are also responsive to the output signal from the load cell 66 which senses the weight of the chlorides in the sublimer 12. Advantageously the crucible 84 and its contents may be cooled as soon as is practicable so that the diffusion of iron at temperatures of about 900° C. or more is minimized. The pressure transmitter 104 and the thermal element 108 also output signals via another interlock 112 to the sublimer 12.

The reactor 14 has a process connection 116 which extends into its interior to prevent plugging. A close connected valve 118 may be employed to shut the reactor 14 off the system 10. The valve need not, but may, be traced.

A commercial sublimer-reactor system embodying the present invention may be employed to produce zirconium metal from zirconium tetrachloride in less than about half the time which may be required in prior art vertically arranged systems. All of the preliminary steps before the reduction step will require less than about 24 hours to prepare 10,000–11,000 lbs. of zirconium-tetrachloride for reaction, the reduction step will require less than about 42 hours to produce 3800–4200 lbs. of zirconium metal sponge and the post reduction steps will require less than about 30 hours for the same production level mentioned previously in systems embodying the present invention.

While a presently preferred embodiment of the present invention as well as certain objects, benefits and details thereof have been shown and described, it is to be distinctly understood that the invention is not limited thereto, but may be otherwise variously embodied within the scope of the following claims.

What is claimed is:

1. A sublimer-reactor system for reducing Group IVB metal chlorides with magnesium to produce the Group IVB metal and byproduct magnesium chloride, comprising:

a sublimer for vaporizing Group IVB metal chloride powders;

at least one reactor for reacting the vaporized chlorides with magnesium, the reactor spaced apart from the sublimer;

piping connecting the sublimer and the reactor;

flow control means in the piping for operatively interconnecting the sublimer and the reactor in vapor flow communication; and weighing means operatively connected with the sublimer and the flow control means for controlling the flow of vaporized chlorides to the reactor in response to the weight of the chlorides in the sublimer.

2. The sublimer-reactor system of claim 1, wherein the weighing means is a load cell.

3. The sublimer-reactor system of claim 1, comprising a plurality of reactors spaced from the sublimer.

4. The sublimer-reactor system of claim 1, further comprising:

cooling means operatively connected with the reactor for cooling the reacted products; wherein the cooling means is responsive to the weighing means operatively connected with the sublimer.

* * * * *